US008038728B2

(12) United States Patent
Xu et al.

(10) Patent No.: US 8,038,728 B2
(45) Date of Patent: Oct. 18, 2011

(54) METHODS OF FABRIC TREATMENT

(75) Inventors: Bing Xu, Kowloon (HK); Ping Gao, New Territories (HK); Cheng Yang, Kowloon (HK)

(73) Assignee: The Hong Kong University of Science and Technology, Hong Kong (CN)

( * ) Notice: Subject to any disclaimer, the term of this patent is extended or adjusted under 35 U.S.C. 154(b) by 143 days.

(21) Appl. No.: 12/068,658

(22) Filed: Feb. 8, 2008

(65) Prior Publication Data

US 2008/0233298 A1 Sep. 25, 2008

Related U.S. Application Data

(63) Continuation-in-part of application No. 10/853,756, filed on May 26, 2004, now abandoned.

(60) Provisional application No. 60/473,123, filed on May 27, 2003.

(51) Int. Cl.
*D06M 15/233* (2006.01)
*D06M 15/263* (2006.01)

(52) U.S. Cl. ..... 8/115.6

(58) Field of Classification Search ..... 8/115.6
See application file for complete search history.

(56) References Cited

U.S. PATENT DOCUMENTS

| | | | | |
|---|---|---|---|---|
| 3,933,875 | A * | 1/1976 | Brose et al. | 428/413 |
| 4,562,097 | A | 12/1985 | Walter et al. | |
| 5,614,591 | A | 3/1997 | Basinger et al. | |
| 5,856,245 | A | 1/1999 | Caldwell et al. | |
| 5,869,172 | A | 2/1999 | Caldwell | |
| 5,874,164 | A | 2/1999 | Caldwell | |
| 5,885,303 | A | 3/1999 | Payet | |
| 5,912,116 | A | 6/1999 | Caldwell | |
| 6,372,674 | B1 | 4/2002 | Lack | |
| 6,521,342 | B1 * | 2/2003 | Hutter et al. | 428/407 |
| 6,607,994 | B2 * | 8/2003 | Linford et al. | 442/59 |
| 6,727,318 | B1 * | 4/2004 | Mathauer et al. | 524/801 |
| 2002/0055602 | A1 * | 5/2002 | Gerle et al. | 528/45 |
| 2004/0074012 | A1 | 4/2004 | Heidenfelder et al. | |

FOREIGN PATENT DOCUMENTS

| | | | |
|---|---|---|---|
| WO | WO 99/40123 | * | 8/1999 |
| WO | WO 99/40123 | A2 | 8/1999 |
| WO | WO 01/06054 | * | 1/2001 |
| WO | WO 01/06054 | A1 | 1/2001 |
| WO | WO 02/063091 | A2 | 8/2002 |
| WO | WO 2005/107456 | * | 11/2005 |

* cited by examiner

*Primary Examiner* — Amina Khan
(74) *Attorney, Agent, or Firm* — The Nath Law Group

(57) ABSTRACT

A method is described for treating fabrics, yarns and individual fibers to improve the mechanical properties thereof, for example their wrinkle-resistance, by treating the fabric, yarn, and fibers in a solution containing polymer nanoparticles. The nanoparticles include two sizes of particles and an appropriate selection of the nanoparticles to control the degree and mode of cross-linking in the fabric with corresponding control of the mechanical properties. The nanoparticles can be provided with an electrical charge that can be opposite in sign to any charge carried by the fabric in order to enhance the formation of a polymer film on the fabric.

8 Claims, 15 Drawing Sheets

METHODS OF FABRIC TREATMENT

This application is a continuation-in-part of U.S. application Ser. No. 10/853,756, filed May 26, 2004, now abandoned which is a conversion of U.S. Provisional Application No. 60/473,123 filed May 27, 2003. These disclosures are incorporated by reference herein in their entirety.

The exemplary embodiments relate to methods for the treatment of fibers, yarns, fabrics and textiles by the generation of a crosslinking architecture on a nanometer or micrometer scale. Such architecture can be applied for treatment of fabrics, yarns and fibers, but not limited to the above, for achieving desired and controlled physical and chemical properties. The exemplary embodiments also extend to fibers, fabrics and textiles so treated.

DESCRIPTION OF THE RELATED ART

Fiber or fabric treatments for achieving valued added properties are valuable in textiles, home furnishing, and composite materials industries. Particularly in textile industries, various processes have been developed to achieve wrinkle-free/durable-press (DP) properties or antibacterial properties. For examples: U.S. Pat. No. 4,562,097 discloses a continuous process for creating a uniform foamable functional composition that can be used in the treatment of a textile fabric to improve its properties. U.S. Pat. No. 5,614,591 discloses an aqueous durable press treatment composition comprising a reactive modified ethylene urea resin, such as dimethylol dihydroxy ethylene urea (DMDHEU), a crosslinking acrylic copolymer derived from butyl acrylate and acrylonitrile, and a catalyst. This well-known process can be applied either to fabrics prior to fabrication into garments, or as a garment durable press process imparting durable press properties to fabricated garments.

As further examples, U.S. Pat. Nos. 5,856,245 and 5,869,172 disclosed a curable thixotropic polymer to form barrier webs that are either impermeable to all microorganisms or are impermeable to microorganisms of certain sizes or imparts specific properties to the end product material. U.S. Pat. No. 5,874,164 discloses novel barrier webs that have certain desirable physical qualities such as water resistance, increased durability, improved barrier qualities. This process is also based on a curable shear thinned thixotropic polymer composition, including fabrics that are capable of either selective binding certain microorganisms, particles or molecules depending upon what binding partners are incorporated into the polymer before application to the fabric.

Additionally, U.S. Pat. No. 5,885,303 provides a durable press wrinkle-free process which comprises treating a cellulosic fiber-containing fabric with formaldehyde, a catalyst capable of catalyzing the crosslinking reaction between the formaldehyde and cellulose and a silicone elastomer, heat-curing the treated cellulose fiber-containing fabric, under conditions at which formaldehyde reacts with cellulose in the presence of the catalyst without a substantial loss of formaldehyde before the reaction of the formaldehyde with cellulose to improve the wrinkle resistance of the fabric in the presence of a silicone elastomeric softener to provide higher wrinkle resistance, and better tear strength after washing, with less treatment. U.S. Pat. No. 5,912,116 presents a process based a curable shear thinned thixotropic polymer composition to offer water resistance, increased durability, improved barrier qualities of fabrics. U.S. Pat. No. 6,372,674 discloses a textile treatment process imparts water repellant, stain resistant, and wrinkle-free properties as well as aesthetically pleasing hand properties to a fabric made in whole or in part of fibers having a hydroxyl group, such as cellulosic fibers, though immersion in an aqueous bath and subsequent heating for curing.

Although the above processes, to some extent, achieved similar properties to exemplary embodiments described herein, many suffer drawbacks such as the loss of tensile strength, abrasion resistance, and tear strength. Therefore, others have sought improvements using nanotechnology. WO 01/06054 discloses textile-reactive beads, whose inner sphere contains "payload"—for example, anti-biologic reagents, dyes, and UV-protecting agents, that can bind or attach to the fibers of the textiles or other webs to be treated, to provide permanent attachment of the payload to the textiles. In this process, the procedure for getting payload insides the nanobeads, however, is hard to control; the sizes of the nanobeads have wide distribution, which is ineffective to control the post-curing properties; and the resulting structure after treatment is unknown, which makes it difficult achieve desired properties; moreover, the persistent problem of the loss of mechanical strength of the treated textiles remains unsolved.

SUMMARY

According to the claimed embodiments, there is provided a method of treating fibers, or a fabric or yarn comprised of individual fibers, comprising the steps of (a) subjecting the fibers to an aqueous solution containing polymer nanoparticles and a cross-linking agent, (b) drying the fibers, and (c) curing the fibers to form a uniform thin polymer film on the surface of fibers.

Preferably the nanoparticles may have a bimodal distribution comprising first nanoparticles of a first size and second nanoparticles of a second size, said second size being larger than the first. For example, the first nanoparticles may have a diameter in the range of from 18 nm to 50 nm, and the second nanoparticles may have a diameter in the range of 35 nm to 100 nm. The diameter of the first nanoparticles may form a narrow distribution within the range of diameters of the first nanoparticles, and the diameter of the second nanoparticles may form a narrow distribution within the range of diameters of the second nanoparticles. Preferably the number of second nanoparticles in the solution is greater than the number first nanoparticles by a ratio in the range of 1:1 to 4.2:1.

In exemplary embodiments, the nanoparticles are formed of surface modified polystyrene. The crosslinking agent may comprise dimethyl dihydroxy ethylene urea (DMDHEU). Preferably the concentration of nanoparticles and cross-linking agent is selected to provide a wet pick-up of 60-70%.

The curing may be performed as a single step at a temperature of between 110-180° C. for between 1 to 20 minutes. More preferably between 140° C. and 180° C. Alternatively, curing can be performed as a two-step process. In some embodiments, prior to step (a), the fibers are subject to an aqueous solution comprising a cross-linking agent and are then cured under an applied pressure, and the curing of step (c) is carried out under an applied pressure.

Preferably the nanoparticles are electrically charged, in particular with a charge that is opposite in sign to that of the fibers. For example, if the fibers have a negative charge, then the nanoparticles may have a positive charge, while if the fibers have a positive charge, the nanoparticles may be provided with a negative charge.

According to another aspect of the present invention there is provided a method of treating fibers, or a fabric or yarn comprised of individual fibers, comprising the steps of (a) subjecting the fibers to an aqueous solution containing electrically charged polymer nanoparticles and a cross-linking agent, (b) drying the fibers, and (c) curing the fibers to form a polymer film on the surface of the fibers.

BRIEF DESCRIPTION OF THE DRAWINGS

Some examples of the invention will now be described by way of example and with reference to the accompanying drawings, in which.

DETAILED DESCRIPTION OF EXEMPLARY EMBODIMENTS

Exemplary embodiments include a method for creating controlled, hierarchical crosslinking structure on fibers and fabrics using nanoparticles, thus enhancing the mechanical properties of cotton fabrics and other materials made of fibers. In particular at least in preferred embodiments the properties of the fibers and materials made from the fibers are enhanced by the formation of a thin uniform polymer layer on the surface of the individual fibers.

Figure 1:
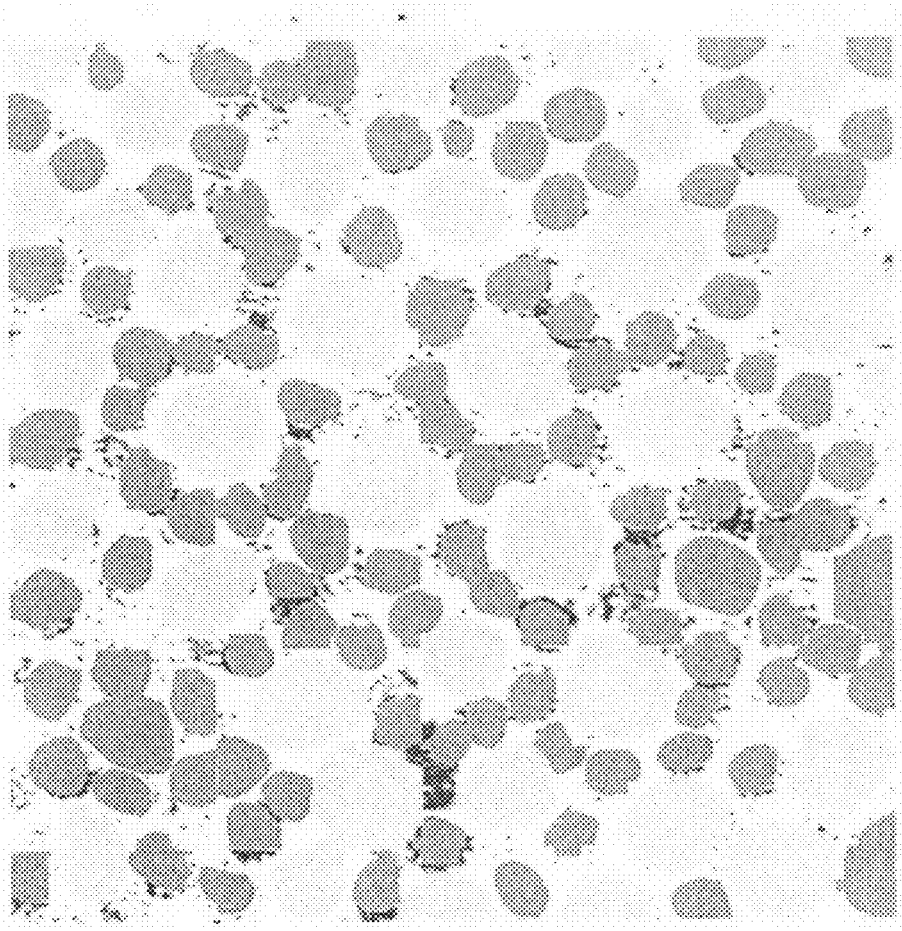
FIG. 1 is an illustration of bimodal (two different sizes) nanoparticles on the surface of a fabric for generation hierarchical structures.

Several key features and benefits distinguish the exemplary embodiments from the related art. As shown in FIG. 1 nanoparticles with different sizes (bimodal) were applied on the fabric (details of preferred application methods will be described below) to generate domains with distinct mechanical and chemical properties in a controlled fashion, and thus offer desired enhancements. FIG. 1 is an illustration of the nanoparticles of the two different sizes applied to the surface of a fabric prior to curing.

Figure 2:
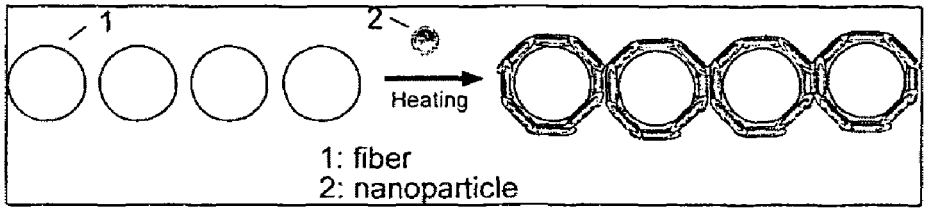
FIG. 2 schematically illustrates nanoparticles on the surface of a yarn for generating hierarchical structures.
Figure 3:
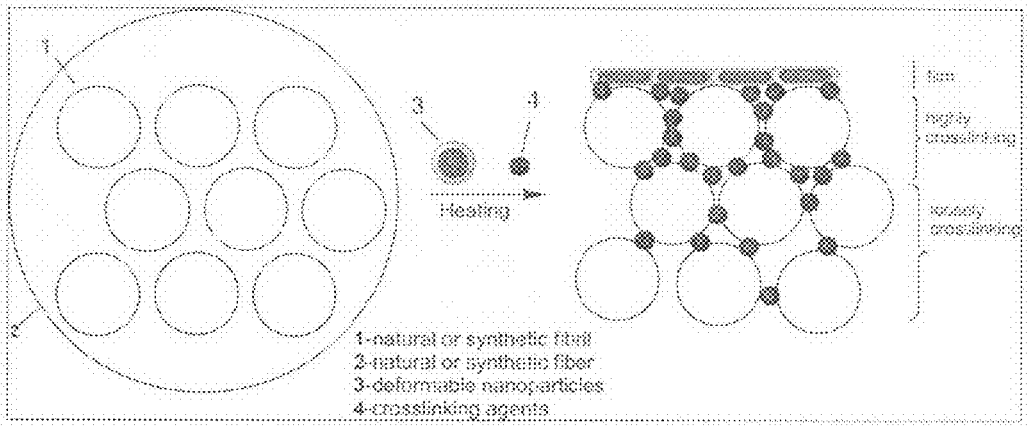
FIG. 3 schematically illustrates nanoparticles on the surface of a fiber for generating hierarchical structures.
Figure 6:
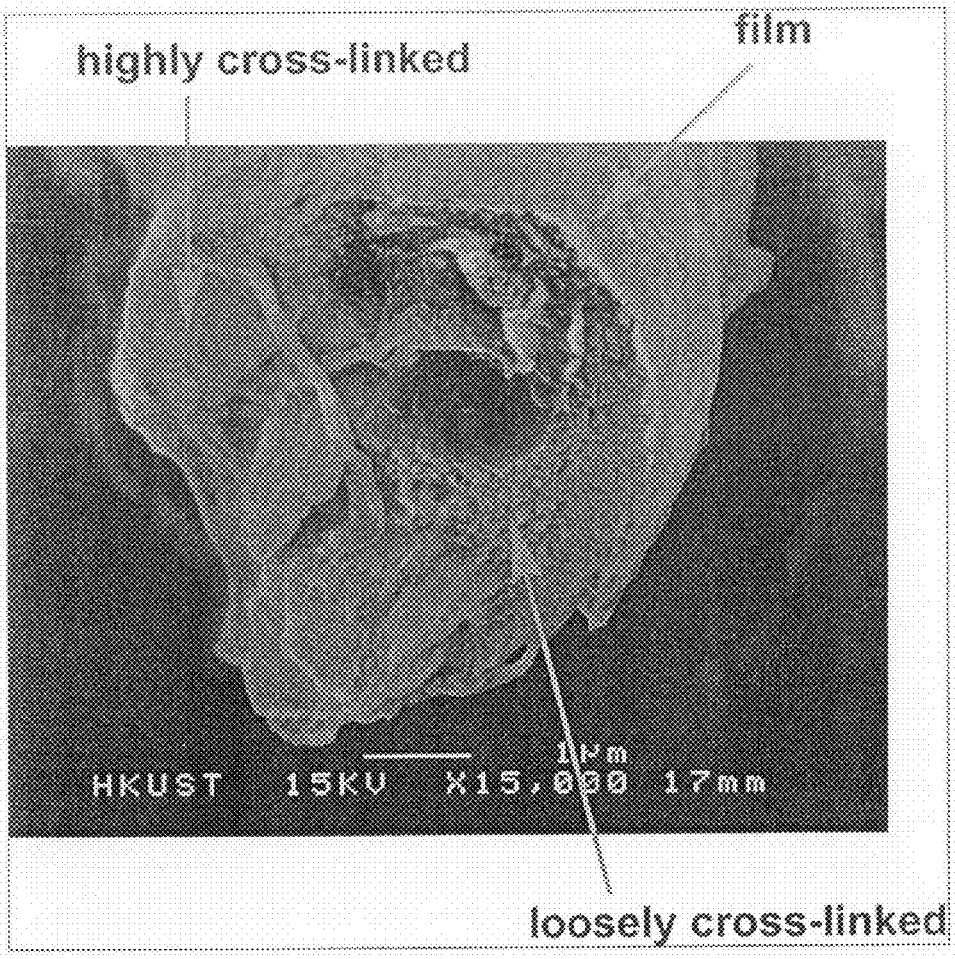
FIG. 6 is a scanning electron micrograph of a hierarchical structures of a fiber.

As shown in FIG. 2, at the level of individual yarns 1, crosslinking was accomplished by nanoparticles 2 plus conventional crosslinking agents (e.g. DMDHEU). At the level of a fiber, where the fiber 3 is formed from multiple fibrils 4 which may be natural or synthetic, as shown in FIGS. 3 and 6, the density of crosslinking exhibits three different degrees, thus inducing three regions with different morphologies, which contributes to the control of the mechanical properties. Again the crosslinking between individual fibrils in the fiber is achieved by nanoparticles 5 in the presence of conventional crosslinking agents and a heating step. With regard to the cross-linking agent, DMDHEU is one particularly suitable choice. However, other cross-linking agents can be used as well, for example, small molecules with multiple —COOH groups or —CHO groups. The concentration of DMDHEU is 15~20% (v:v), catalyst (eg $MgCl_2$ or $ZnCl_2$, with the latter being less preferred for biocompatibility reasons) 6~20 g/L, and the nanoparticles content 3~10 g/L. Generally, more DMDHEU and more nanoparticles lead to a higher density of cross-linking. However, it is both the amount of the cross-linking and the mode of the cross-linking (the crosslinking density difference on the surface of a cotton fiber and the core of a fiber as shown in FIG. 6) that determine the final performance of the fabric. The amount of nanoparticles used and the sizes of the nanoparticles will affect the mode of cross-linking which is reflected in the recovery angles as can be seen from FIG. 8 to be discussed further below. In exemplary embodiments, the use of nanoparticles controls both the modes and the amount of the cross-linking, thus offers improved mechanical properties. An important aspect of the exemplary embodiments is that through the appropriate use of nanoparticles, the amount of cross-linking on the surface of the fibers is increased to the extent that after curing a thin film is formed on the surface of the fibers, and the amount of cross-linking in the core of the fiber is minimized.

The nanoparticles used may comprise or consist essentially of a mixture of smaller and larger particles. The smaller particles preferably range from 18 nm to 50 nm in diameter, while the larger particles will range from 35 nm to 100 nm in diameter. In mixtures of exemplary embodiments, the smaller and larger particles are narrowly distributed within their respective size bands (i.e., although the smaller particles may range between 18 nm and 50 nm in any exemplary mixture the range of sizes of the smaller particles will be narrower than that), and the number of larger particles will exceed the number of smaller particles by a ratio in the range of 1:1 to 4.2:1.

Figure 4:
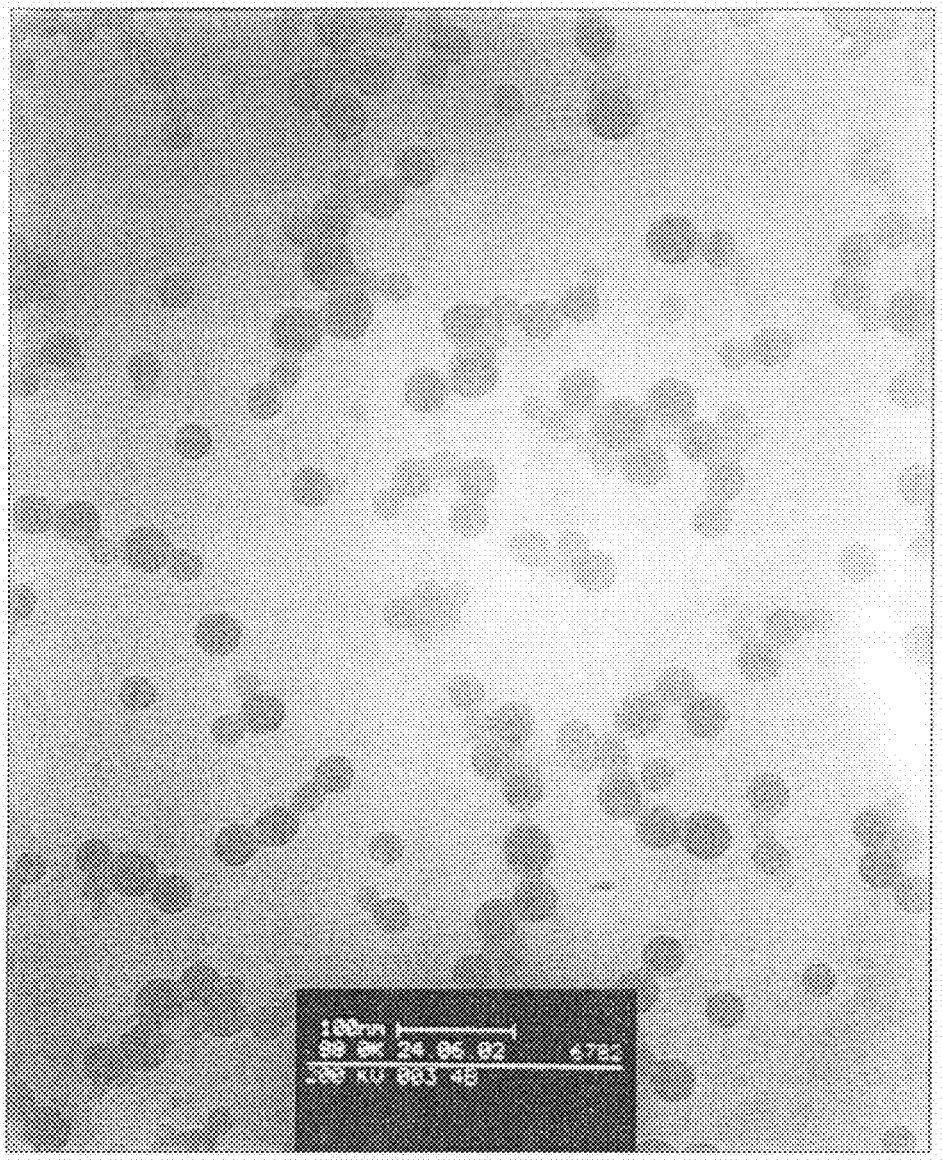
FIG. 4 is a scanning electron micrograph of the narrow-dispersed nanoparticles.
Figure 5:
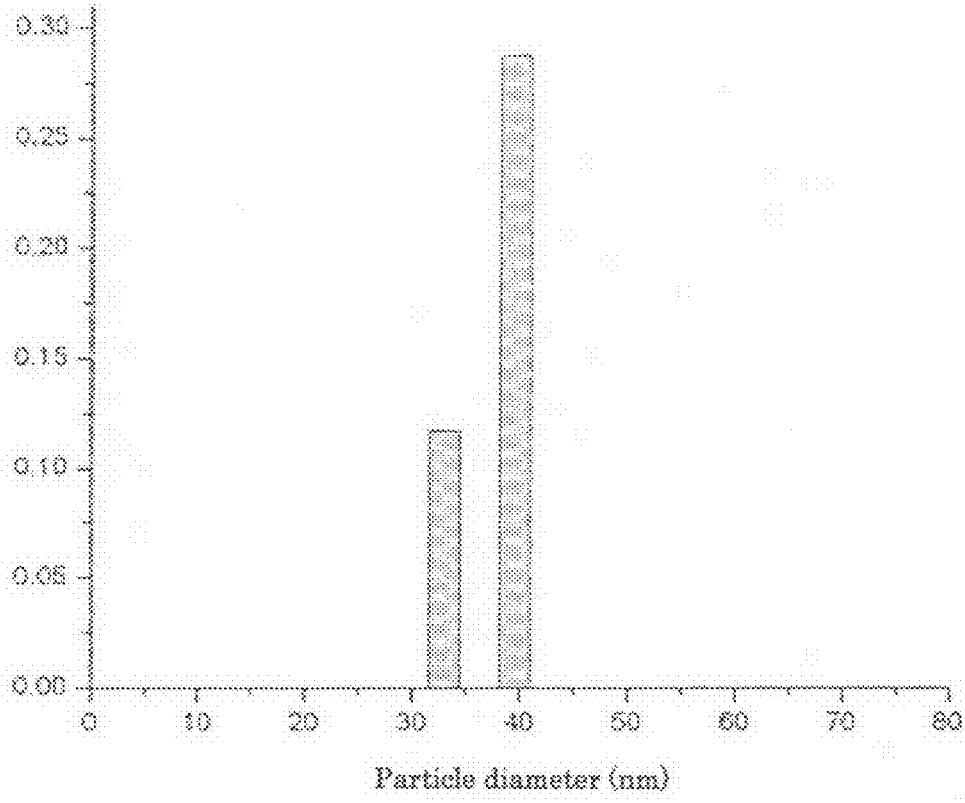
FIG. 5 is a plot illustrating the size distribution of the nanoparticles.

FIG. 4 shows a scanning electromicrograph of suitable nanoparticles and FIG. 5 shows a plot of the size distributions of a preferred example. In FIG. 5, for example, the smaller nanoparticles have diameters in a narrow band around 33 nm, and the larger particles have a diameter in a narrow band around 40 nm (e.g., about + or −3 nm). The size of the nanoparticles can be controlled to provide the foundation for bimodal distribution of the particles on the surface of the fabrics. The nanoparticles and cross-linking agents are provided to the fabric in an aqueous solution, and their amounts are controlled to achieve wet pick-up 60-70%. The curing temperature is preferably from 105~170° C., and the curing time 1~20 minutes.

The function of the nanoparticles is to act as a seed to form a hierarchical nanostructure and any polymer material can be used for the nanoparticles. A suitable material, for example, is surface modified polystyrene with the surface modification providing the covalent link between the nanoparticles and the fabric. Surface modification may be achieved, for example, by covalently linking —OH or —COOH groups on the surface of the polystyrene during the synthesis of nanoparticles. Other forms of surface modification are possible, however, for example by oxidation of the surface of the polystyrene to form —COOH groups or by reduction to form —OH groups.

For use in the examples below, the polystyrene nanoparticles were synthesized through water emulsion using styrene (ST) and acrylic acid (AA) in a certain weight ratio with or without surfactants at a particular polymerization condition. All emulsion polymerization reactions were carried in a three-neck flask. The flask was equipped with a condenser and inlets for nitrogen. Prior to polymerization, the reaction mixture was degassed by nitrogen flow, and nitrogen was maintained during the synthesis. A typical procedure was follows: 1) Addition of 0.6 g SDS and 0.24 g sodium hydrogen carbonate into 75 ml water to form a solution; 2) addition of 15.6 ml styrene, 2.2 ml acrylic acid and 2.2 ml hydroxyl ethyl methyl acrylate (HEMA) into solution; 3) after 20 minutes stirring, add 0.2 g potassium persulfate (KPS) dissolved in 5 ml water into above solution when temperature increase at 50° C.; and 4) increase the temperature and keep it at 75° C. for another 5 hours until the reaction finished. The morphology of the nanoparticles was examined using a Phillips CM 20 transmission electron microscope (TEM) with an acceleration voltage of 200 kV. The nanoparticles were fished onto a carbon-coated copper grid before examination. FIG. 5 shows the size-distribution of the nanoparticles measured by light scattering. This solution of nanoparticles was then used with crosslinking agents (e.g. DMDHEU) for the treatment of the fabrics.

Table 1 shows the three compositions of the nanoparticles used in the Examples below.

TABLE 1

| Sample # | 1 | 2 | 3 |
|---|---|---|---|
| Water (ml) | 80 | 80 | 90 |
| Styrene (ml) | 15.6 | 5.5 | 10 |
| Acrylic acid (ml) | 2.2 | 0.5 | 1 |
| Hydroxyl ethyl methyl acrylate (ml) | 2.2 | 0 | 0 |
| Potassium persulfate (g) | 0.2 | 0.06 | 0.11 |
| SDS (g) | 0.6 | 10 | 0 |
| $NaHCO_3$ (g) | 0.24 | 0.24 | 0.12 |
| Temperature (° C.) | 75 | 75 | 75 |
| Time (h) | 5 | 5 | 5 |
| Size of the nanoparticles (nm) | 21 ± 1.5, 35 ± 1.5 | 33 ± 1.5, 39 ± 1.5 | 94~120 |

Using these nanoparticles the following examples were prepared. In each of these Examples the nanoparticles were from Sample 2 above with the sizes and relative numbers as shown in FIGS. 4 & 5:

EXAMPLE 1

100% cotton fabric (160 mm×72 mm, 80/2//×80/2 pinpoint oxford) was immersed in an aqueous solution (27 wt % DMDHEU, 1.4 wt % $MgCl_2$, 1.5 wt % nanoparticles, and 4.4 wt % commercial softener) and subject to ultrasonic vibration for 1 minute. The fabric was pressed to give a wet pick-up of about 70% and then dried at 80-90° C. for 4 hours, and cured at 140~150° C. for 15 minutes. Then, the properties of the fabric were tested: the recovery angle of treated fabrics was measured according to the AATCC 66 test of option 2; the tensile test was carried out using Instron 4466 following the ASTM D5034 standard. The results of measurements are: Recovery angle 256°.

EXAMPLE 2

100% cotton fabric (160 mm×72 mm, 80/2//×80/2 pinpoint oxford) was immersed in an aqueous solution of 1.5 wt % nanoparticles, and subject to ultrasonic vibration for 1 minute. Then an aqueous solution containing 27 wt % DMDHEU, 1.4 wt % $MgCl_2$, and 4.4 wt % commercial softener was added in the same solution. The fabric was immersed for 5~10 minutes and pressed to give a wet pick-up of about 70%, then dried at 80-90° C. for 4 hours, and cured at 140-150° C. for 15 minutes. Then, the properties of the fabric were tested as in Example 1. The results of measurements were: Recovery angle 262°, tensile retention (72% wft, 85% wrp), and abrasion 27000 revolution.

EXAMPLE 3

100% cotton fabric (160 mm×72 mm, 80/2//×80/2 pinpoint oxford) was immersed in the aqueous solution containing 27 wt % DMDHEU, 1.4 wt % $MgCl_2$, and 4.4 wt % commercial softener for 5~10 minutes. Then 1.5 wt % nanoparticles, were added to the solution and ultrasonic vibration was provided for 1 minute. The fabric as pressed to give a wet pick-up of about 70% and then dried at 80-90° C. for 4 hours, and cured at 140-150° C. for 15 minutes. Then, the properties of the fabric were tested as in Example 1. The results of measurements are: Recovery angle 212°.

EXAMPLE 4

This example is of a two-step constrained curing. The fabric was treated with a solution consisting of 15% DMDHEU, $MgCl_2$ (6 g/L) for 5~10 minutes. After the excess solution was removed by padding, the wet pick-up of samples is ~65%. After the fabric was air dried, it was cured at 110° C. for 30 minutes between two flat glass plates with applied pressure. After that, the fabric was treated with a solution consisting of 5% DMDHEU, $MgCl_2$ (3 g/L), and the nanoparticles (0.5-1.5 wt %) for 5~10 minutes. After the excess solution was removed by padding, the wet pick-up of samples is ~80%. After the fabric was air dried, it was cured at 160° C. for 3 minutes between two flat glass plates with applied pressure. The measured recovery angle was 270~284°, the tensile strength 68%~79%, and the tearing strength 47%~59%.

EXAMPLE 5

100% cotton fabric (160 mm×72 mm, 80/2//×80/2 pinpoint oxford) was immersed in an aqueous solution (30% DMDHEU, 7 wt % $MgCl_2$, 0 or 1.5 wt % nanoparticles, and 4.4 wt % commercial softener) for periods of 1, 5, and 10 minutes. The fabric was pressed to give a wet pick-up of ~70% and then dried at 80-90° C. for 4 hours, and cured at 150° C. for 15 minutes. Then, the properties of the fabric were tested: the recovery angle of treated fabrics was measured according to the AATCC 66 test of option 2. Recovery angles are given in FIG. 7.

EXAMPLE 6

100% cotton fabric (160 mm×72 mm, 80/2//×80/2 pinpoint oxford) was immersed in an aqueous solution (30% DMDHEU, 7 wt % $MgCl_2$, 0 to 1.8 wt % nanoparticles, and 4.4 wt % commercial softener) and ultrasonic for 1 minute. The fabric was pressed to give a wet pick-up of ~70% and dried at 80-90° C. for 4 hours, and cured at 150° C. for 15 minutes. Then, the properties of the fabric were tested: the recovery angle of treated fabrics was measured according to the AATCC 66 test of option 2. Recovery angles are given in FIG. 8.

In these examples the mechanical properties were measured according to existing industrial standards. The recovery angle of the treated fabrics was measured according to the AATCC 66 test of option 2. The grab test was also performed to assess the change of tensile properties of the fibrils after the treatment. The tensile test was carried out using Instron 4466 following the ASTM D5034-1995 standard. The abrasion tests were also carried out under the guideline of ASTM D-4966-1989 standard.

Figure 7:
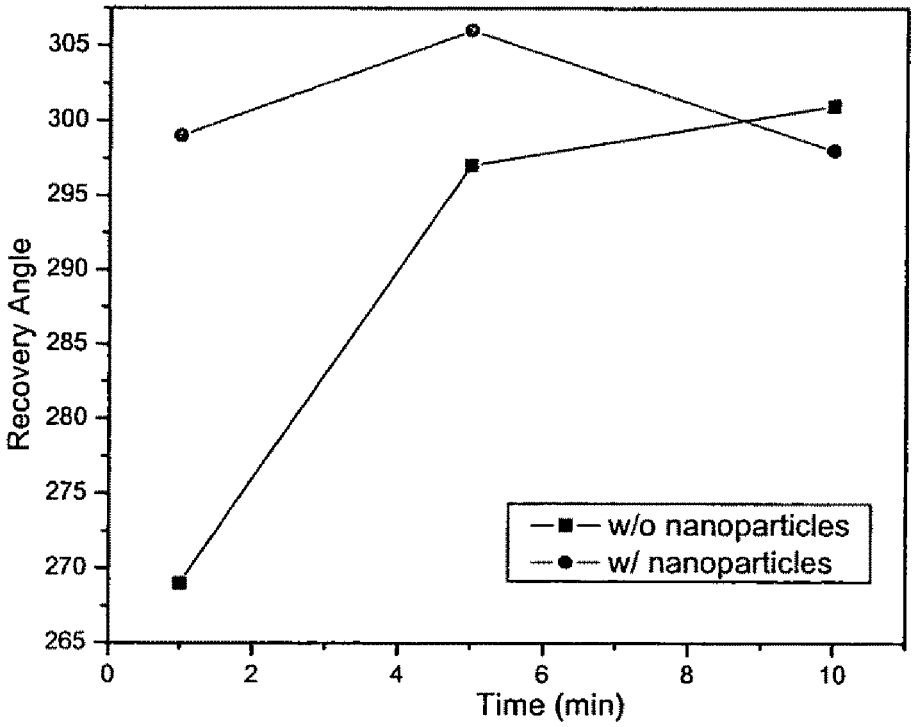
FIG. 7 is a plot showing the increase of the efficiency for the treatment of fabric by using nanoparticles.

As shown in FIG. 7, the time of immersion fabrics in the bath of nanoparticles is reduced, compared to treatments without nanoparticles, and thus leads to higher efficiency of the process of the treatment. In this Figure the data for the fabric with nanoparticles is as in Example 5. The plot showing a fabric without the use of nanoparticles is obtained from a similar process as in Example 5 but without the application of the nanoparticles and with the application of DMDHEU.

Figure 8:
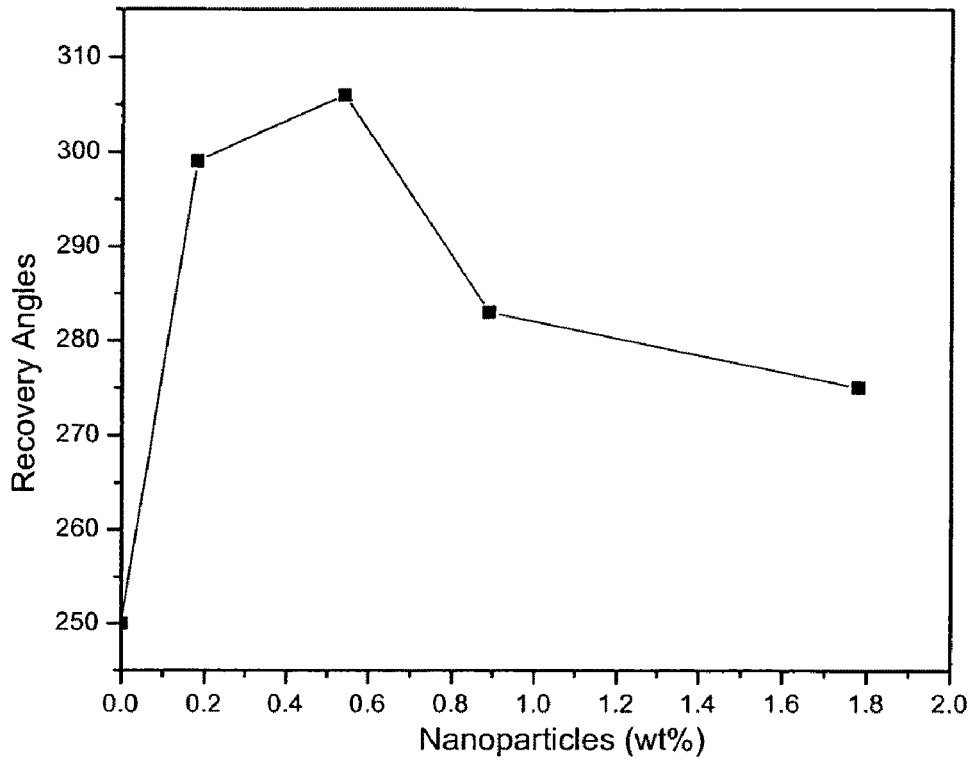
FIG. 8 is a plot showing the relation between recovery angles and the amounts of nanoparticles used.

FIG. 8 illustrates the recovery angle as a function of the pick-up of the nanoparticles, which can be controlled easily by the concentration of nanoparticles. Other than the varying wt % of the nanoparticles, the data of FIG. 8 is obtained using the process of Example 6. A recovery angle of greater than 260° is considered to be indicative of excellent wrinkle-resistance and it can be seen from FIG. 8 that this recovery angle can be equaled or bettered with a wt % of nanoparticles from about 0.02 to at least 1.8 wt %.

Figure 9:
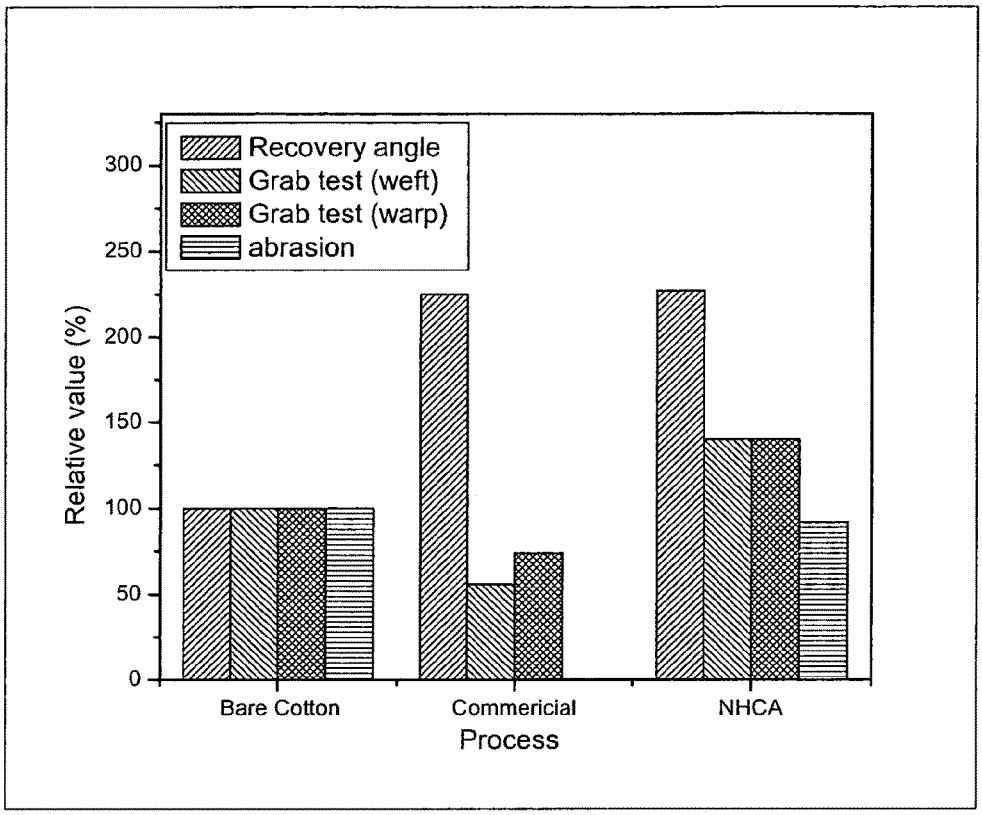
FIG. 9 is a plot showing a comparison of recovery angle and mechanical properties of untreated samples, samples treated by conventional methods, and samples treated by an exemplary embodiment.

FIG. 9 shows the comparison between non-treated native cotton, conventionally treated, and an exemplary embodiment fabric treatment in terms of mechanical properties. In the physical performance indicators illustrated in FIG. 9, the process according to exemplary embodiments described herein produces samples with the best result. The data for the "commercial process" fabric is obtained from a fabric treated with a known industrial formulation.

For further study of the nanoparticles and properties of the resulting treated fabrics nanoparticles were prepared in accordance with the following method.

Nanoparticles (about 40 nm in diameter) were prepared using a seeded emulsion polymerization method. The polymerization was conducted in a 2-liter fermenter reactor equipped with four baffles a six-blade pitched paddle impeller. The width of the baffles was 1 cm, and the diameter and width of the impeller were 5 cm and 1 cm respectively. The impeller was located at one-third of the liquid height from the bottom. The polymerization protocol involved the following steps. Firstly, an aqueous solution of seed monomers was deoxygenated by bubbling with nitrogen for 30 minutes under stirring. This bubbling was continued while the reactor was heated to 50° C. using a circulating water jacket, then an initiator solution was added to the reaction mixture to initiate polymerization. The heating was continued at a rate of 1° C./min until the temperature reached 67° C. at which point a mixture of vinylbenzyltrimethylammonium chloride (VBTMAC) as an amphiphilic monomer, N-hydroxylmethyl acrylamide (NHMAm) and hydroxylethyl methacrylate (HEMA) was dropped in at a rate of 40 ml/h using a dropping funnel. The temperature was kept constant for 5 hours, and then the reaction was stopped by reducing the temperature gradually to room temperature. All runs were conducted under a nitrogen atmosphere at an impeller speed of 350 rpm.

VBTMAC is chosen as an amphiphilic monomer to reduce contamination effects from small molecular surfactants because the electrical double layers of the nanoparticles will be more stable to the environment. Furthermore the positively charged VBTMAC functional group will force the emulsion nanoparticles to adhere to a negatively charged fabric surface.

N-hydroxylmethyl acrylamide (NHMAm) and hydroxylethyl methacrylate (HEMA) can be chosen to enhance the reactivity of the nanoparticles towards cellulose. The methlyol group and primary hydroxyl group facilitate the reaction of the nanoparticles with dinethylol dihydroxyethyleneurea (DMDHEU) and a fiber to form a covalent bond through dehydration at elevated temperature.

The nanoparticles thus formed may be characterized as follows. (1) The surface morphology of the nanoparticles may be characterized using a JEOL 2010 transmission electron microscope (TEM) and a Digital Instruments Scanning Probe Microscope-Nanoscope Atomic Force Microscope (AFM). (2) A JEOL 6700F scanning electron microscope (SEM) may be used to characterize the surface morphology of a textile sample after coating with nanoparticles after wet pick-up. (3) A light-scattering method may be used to analyze the hydrodynamic size distribution of the emulsions. (4) The nanoparticles may be spin-coated onto silicon wafers, dried at ambient temperature, and four samples heated for 10 minutes at 80° C., 110°, 140° and 180° respectively. AFM analysis may be performed on these samples with tapping mode in order to study the phase transition of the polymer domains after different temperature treatments.

In addition to analyzing samples of the nanoparticles after heat treatment, samples of native cotton fabric (1 $cm^2$) coated with nanoparticles were also analyzed after being heated for 10 minutes at 80° C., 110°, 140° and 180° respectively (5) ToF-SIMS measurements may be performed on a Physical Electronics PHI 7200 ToF-SIMS spectrometer. The chemical spectra of the nanoparticles may be acquired in the negative mode using a $Ga^+$ liquid metal ion source operating at 25 keV with a total ion dose lower than $4\times10^{12}$ ions/$cm^2$ in a high vacuum of $1.5\times10^{-9}$ Torr. (6) Zeta potential of the nanoparticles at different pH values may be analyzed using a Delsa 440SX Zeta Potential Analyzer. In this analysis the nanoparticles are diluted in 0.01 M NaCl solution with HCl or NaOH used to adjust the pH value. All measurements are made on dispersions that had been equilibriated for 24 hours at the appropriate pH value.

Using nanoparticles as fabricated above, designated for convenience in the following as "NP", the following example of fabric treatment may be given.

EXAMPLE 6

A total volume of 500 ml aqueous solution containing volume concentration of 18 wt % resin (DMDHEU), 1.2 wt % catalyst ($MgCl_2$), 8 wt % softeners (4% siloxane, 4% PE-siloxane), and NP nanoparticles (0.015 wt %) were well dispersed together with deionized water (DI water). Five pieces of 300×200 mm textile sample were dipped in the bath of the suspension, and they were rinsed gently for 7 minutes. Then the samples were picked up and padded at 15 kg/cm$^2$ to achieve 80 wt % wet pick-up. Afterwards, each of them was placed into a 3-kg tumble dryer (ZANUSSI TD-892N) and dried at 60° C. for 7 minutes to achieve around 25 wt % wet pick-up. Then the sample was hand ironed at 110° C. to remove wrinkles before it was fixed between two pieces of glass plates (300×200×3 mm) and cured at 145° C. for 6.5 minutes in a Memmert ULE500 oven.

The mechanical properties of the samples thus treated were then tested following general methods used for durable-press (DP) fabrics. Six samples were used for tear and tensile tests, abrasion tests were performed on two samples. Strips cut from the fabric samples after DP rating were used to measure breaking strength (ASTM D 1682-64; Instron Tester, cross-head speeds of 10 in./min); tearing strength (ASTM D 1424-63; Elmendorf Tear Tester 1600 g weight); abrasion (ASTM D 1175-64; Universal Wear Tester); durable-press rating (5 grades) (AATCC Test method 124-1969); and wrinkle recovery in the weft direction (ASTM D 1295-67; Monsanto Tester, 500 g weight). All tests were carried out in an air-conditioned closet at 21±2° C. with a relative humidity of 65±2% for equilibrium.

Size Distribution of Nanoparticles

Figure 10:
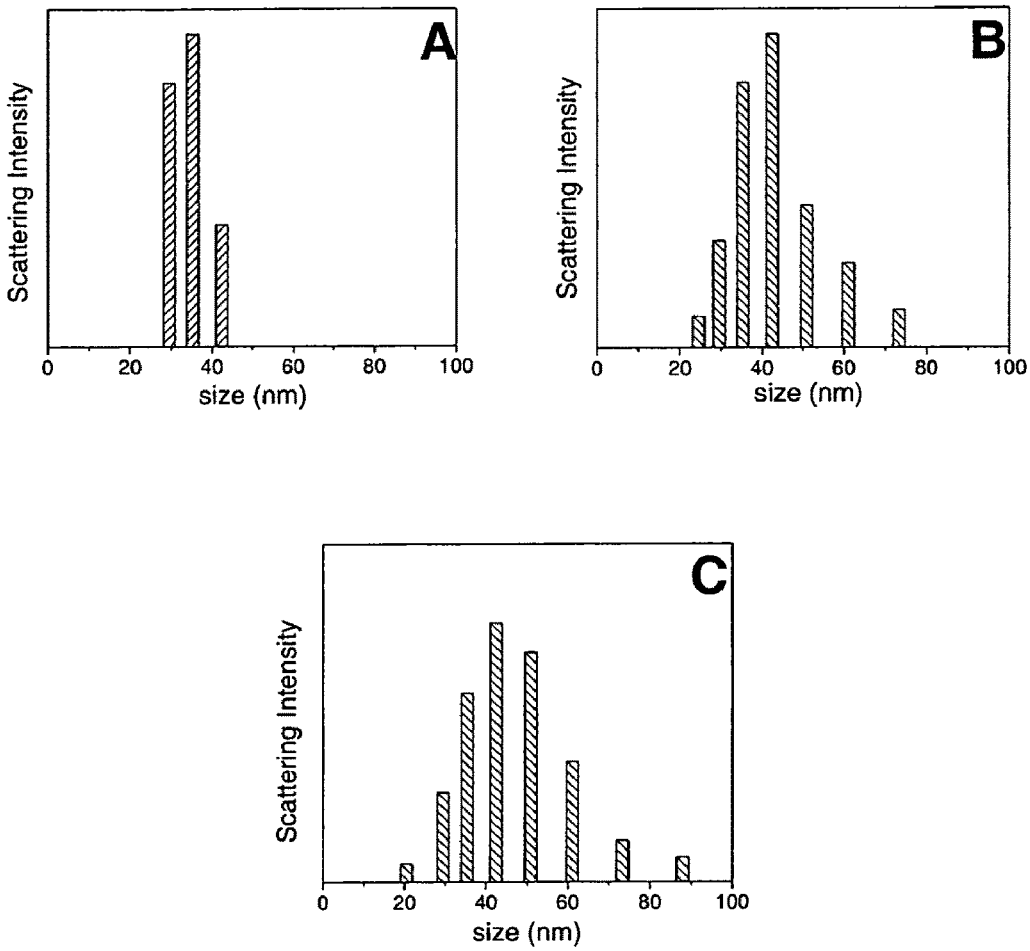
FIG. 10 shows particle size distributions of nanoparticles according to an embodiment in (A) distilled water, (B) 12 g/L $MgCl_2$ solution, and (C) 15% DMDHEU and 12 g/L $MgCl_2$ solution.

The colloidal stability of the nanoparticles was demonstrated with the light scattering method. The concentration of the electrolyte of $MgCl_2$ in this study was 12 g/L to simulate a dipping condition. After mixing the nanoparticles in the $MgCl_2$ for 8 hours, the NP particles were analysed with dynamic light scattering. Test results showed that NP nanoparticles were quite stable in the $MgCl_2$ solution after 8 hours (FIG. 10). This demonstrates that the NP nanoparticles could be well dispersed in the catalyst solution for a long enough time to permit a commercial cycling dipping process. In addition the NP nanoparticles demonstrated good dispersibility in DMDHEU-$MgCl_2$.

Phase Transition of Nanoparticle Films

The surface functionality of the nanoparticles at elevated temperatures and their ability to form a film is important for the efficiency of the fabric treatment process. However, there is a phase transition process for the copolymer nanoparticles that may affect the reactivity of the surface functional groups. In order to characterize the surface functionality of the NP nanoparticles upon film formation after deposition onto the fiber surface ToF-SIMS analysis may be carried out on the nanoparticles after different thermal treatments.

Figure 11:
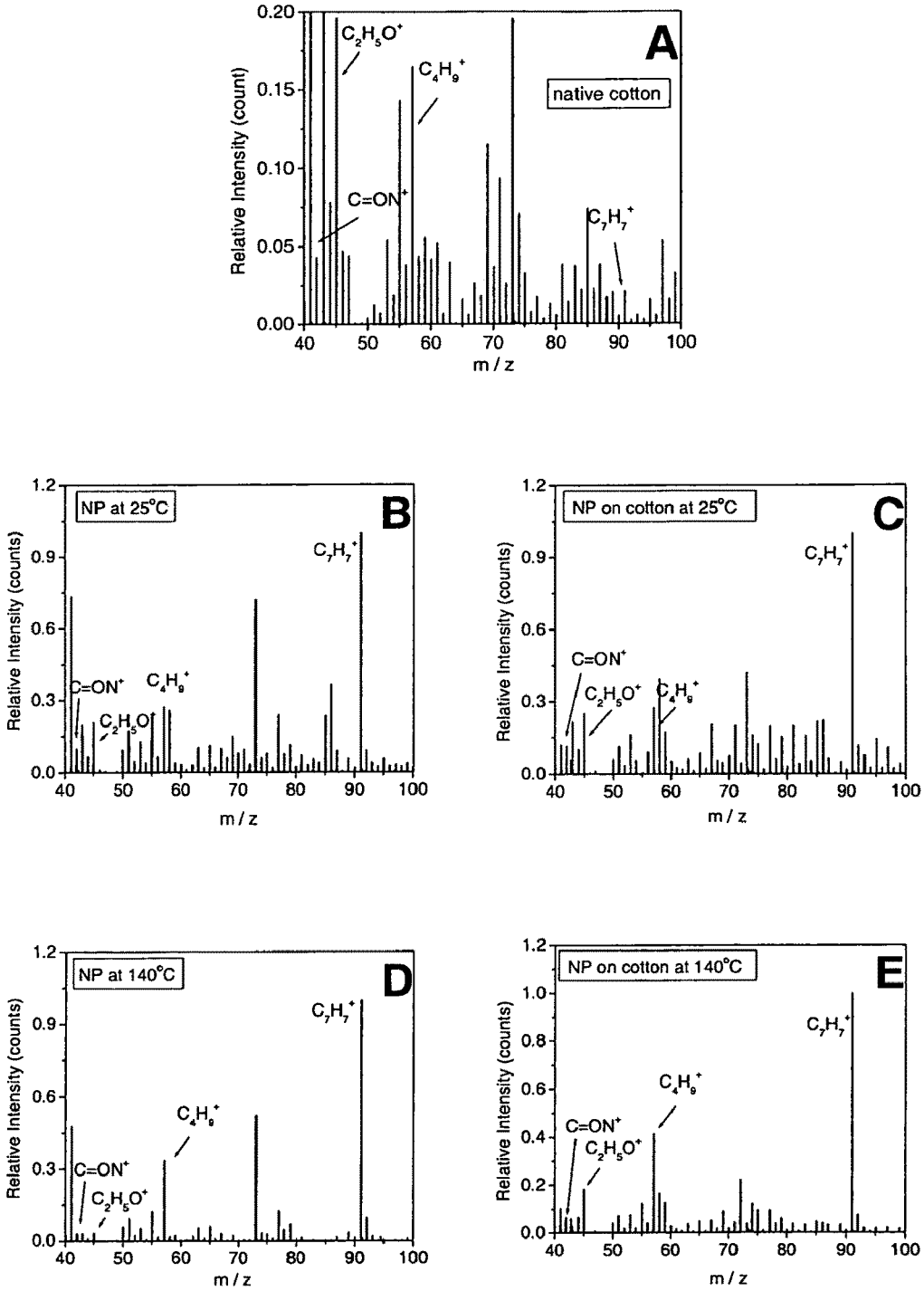
FIG. 11 shows ToF-SIMS spectra of (A) native cotton fabric sample; (B) room temperature dried nanoparticles at 25° C.; (C) 0.1% nanoparticles coated on cotton fiber with 80% wet pick-up and dried at room temperature; (D) room temperature dried nanoparticles cured at 140° C. for 10 minutes; and (E) 0.1% nanoparticles coated on cotton fiber with 80% wet pick-up and cured at 140° C. for 10 minutes.
Figure 12:
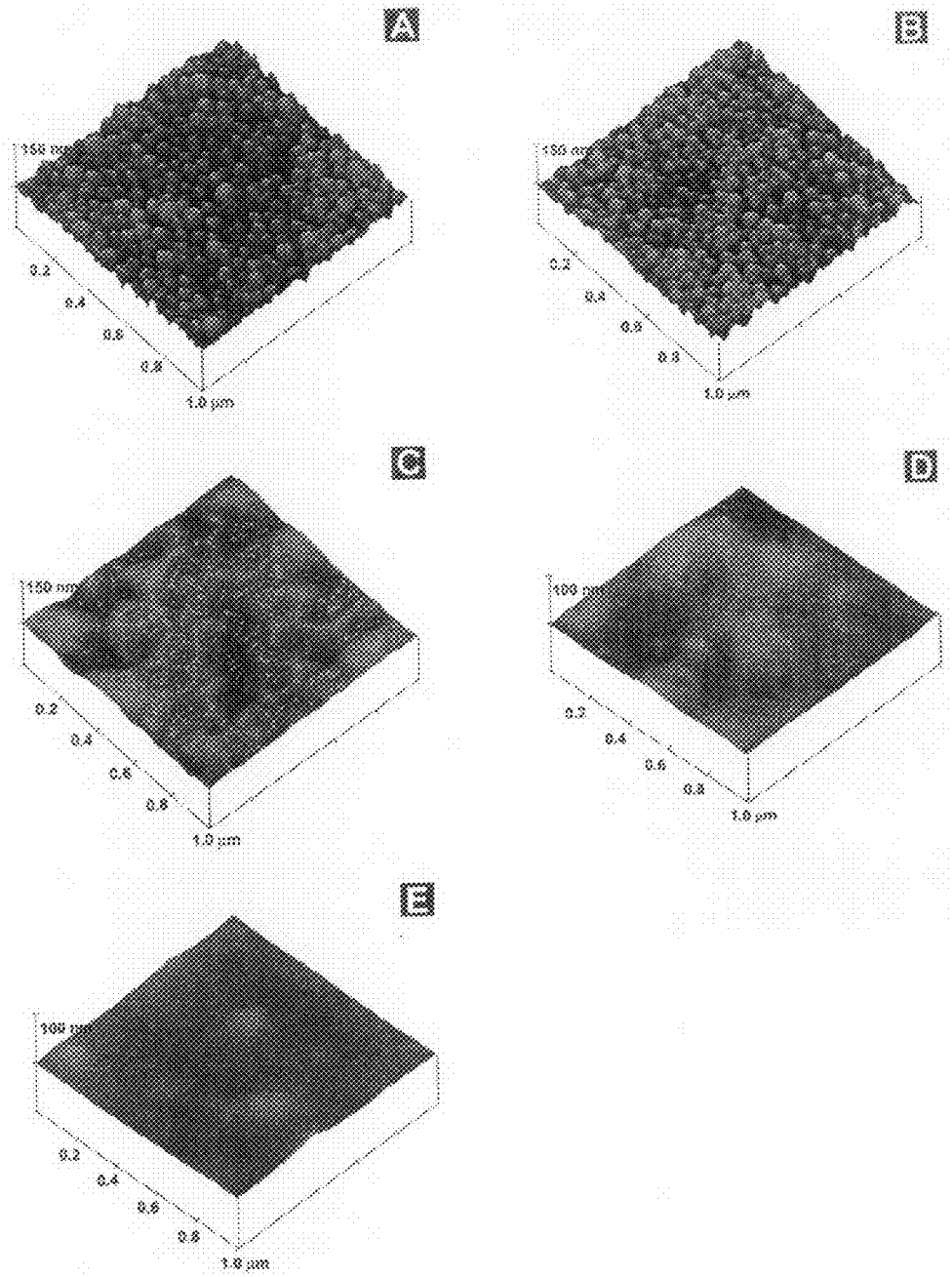
FIG. 12 shows the results of atomic force microscopy (AFM) analysis of room temperature dried nanoparticles (a) at room temperature, (b) heated to 80° C. for 10 minutes, (c) heated to 110° C. for 10 minutes, (d) heated to 140° C. for 10 minutes, and (e) heated to 180° C. for 10 minutes.

The samples were loaded on two different surfaces. One sample was loaded onto a silicon wafer (FIGS. 11-B and D) in order to facilitate the analysis in their morphology using AFM (FIG. 12)). The other sample was applied onto a cotton fabric surface which represents a more realistic situation for practical uses (FIGS. 11-C and E). In addition, a native cotton fabric sample was used as a control (FIG. 11-A) for ToF-SIMS analysis. In the ToF-SIMS spectra, attention was focused on the major characteristic peaks at m/z 42, 45, 57, and 91. The characteristic troplium cation $C_7H_7^+$ peak (m/z 91) which originated from polystyrene (PS) was used as a reference to illustrate the intensities of other peaks (relative intensity was termed 1 in all samples except for native cotton).

The relative intensities of all other peaks over it were used to indicate the relative abundance of the functional groups at the surface corresponding to temperature rises. m/z 57 ($C_4H_9^+$) is the characteristic peak for the component of polybutyl acrylate (PBA). BA is a hydrophobic monomer with a very low glass transition temperature. PBA region has the highest relative intensity to $C_7H_7^+$ when temperature is at 140° C. In FIGS. 11-B and D (also in table 2), the characteristic peak for polyhydroxylethyl methacrylate (PHEMA) domain ($C_2H_5O^+$, m/z 45) decreased drastically from approximately 21% to 3% when temperature was raised from 25° C. to 140° C. However, on cotton, the relative intensity of the same fragment ($C_2H_5O^+$) changed from 25% to 18% when the temperature was raised from 25° C. to 140° C. The reference background of the native cotton surface is insignificant (FIG. 11-A). These results reflect that the cotton surface has the ability to inhibit the phase transition of the nanoparticles. This phenomenon shows that the nanoparticles may have even higher reactivity on cotton fabric at 140° C., which is the temperature for the DP curing process. The fragment of $C{=}ON^+$ (m/z 42) may originate from both NHMAm and VBTMAC. The intensity of this cation did not show much difference at the temperature of 140° C. on both the silicon wafer and cotton surface. This test proves that the NP nanoparticles have a reactivity potency towards both cellulose and resin during the fabric curing treatment. Topological analysis of the nanoparticles under different temperatures.

In addition to the functionality analysis of NP under different temperatures, the topological features of the dried NP films were observed using atomic force microscopy (AFM) under the corresponding temperatures of ToF-SIMS studies. At 25° C. (FIG. 12-A), the spherical structure of the nanoparticles remained intact. It may be noticed that the topology of the nanoparticles surface was not as sharp as before heat treatment when the temperature was raised and kept at 80° C. (FIG. 12-B) for 10 minutes before scanning. This morphological change indicates that at 80° C. only minor phase-transition took place at the surface. It may be observed that the nanoparticles merged into a film with a rippled texture at the surface texture when the temperature raised and kept at 110° C. (FIG. 12-C) for 10 minutes before scanning the sample. Then when the temperature is further raised to 140° C. and 180° C. (FIGS. 12-D, E), which are temperatures above the glass transition temperature ($T_g$) of most of the polymer chains involved it may be noticed that the surface of the nanofilm got even flatter as the temperature increased. The glass transition temperature of the NP film is between 80° C. and 110° C.

Surface Morphology of the Nanoparticle Treated Fiber Samples.

Figure 13:
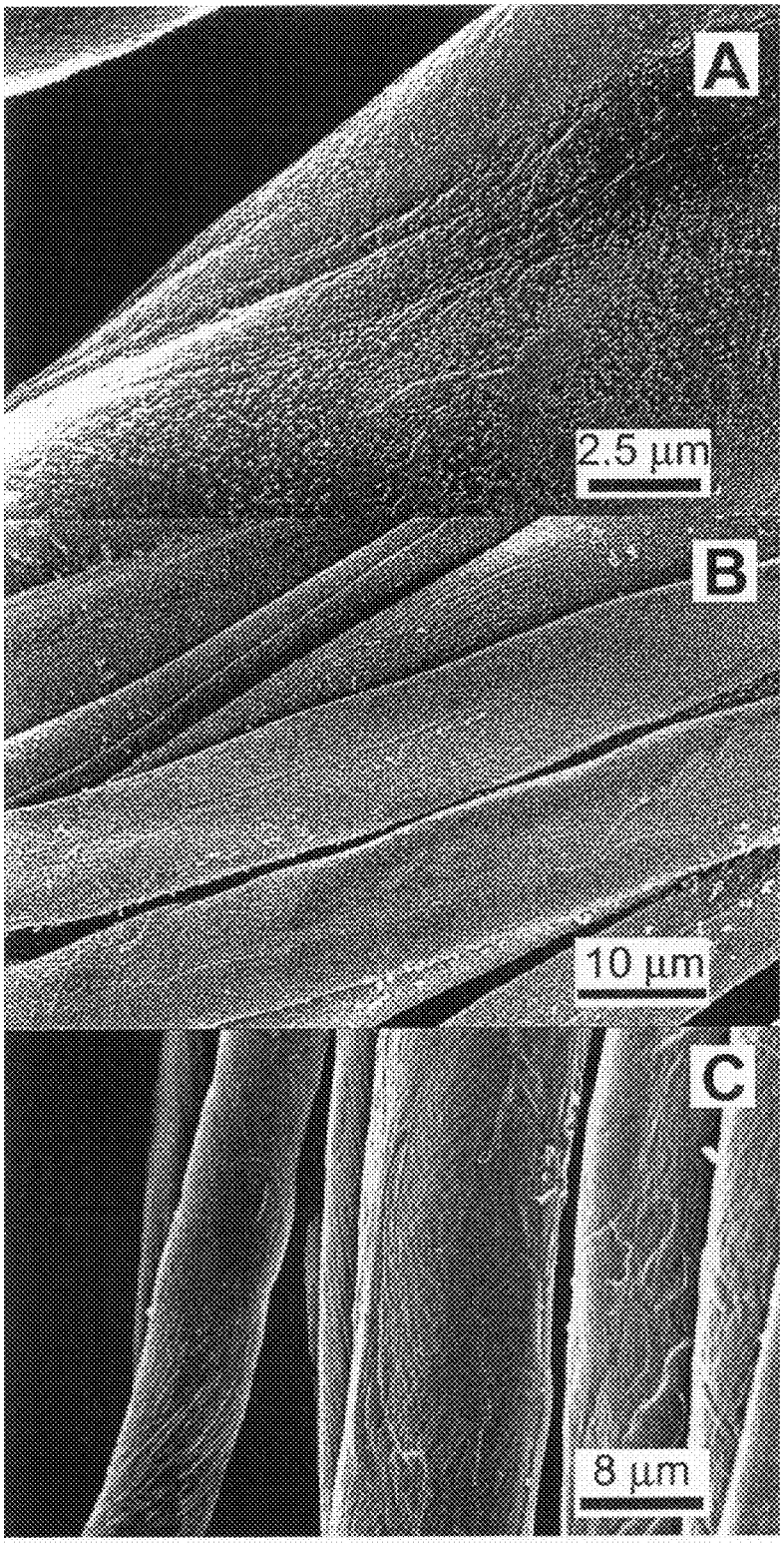
FIG. 13 shows the results of a scanning electron microscope (SEM) analysis of fabric samples after a treatment process according to an exemplary embodiment where (A), (B) are high and low magnified SEM images of nanoparticle treated fabric; (C) shows the treated fabric after the curing step; (D), (E) are high and low magnified SEM images of a fabric treated with other nanoparticles; and (F) shows the treated fabric of (D) and (E) after the curing step.
Figure 13:
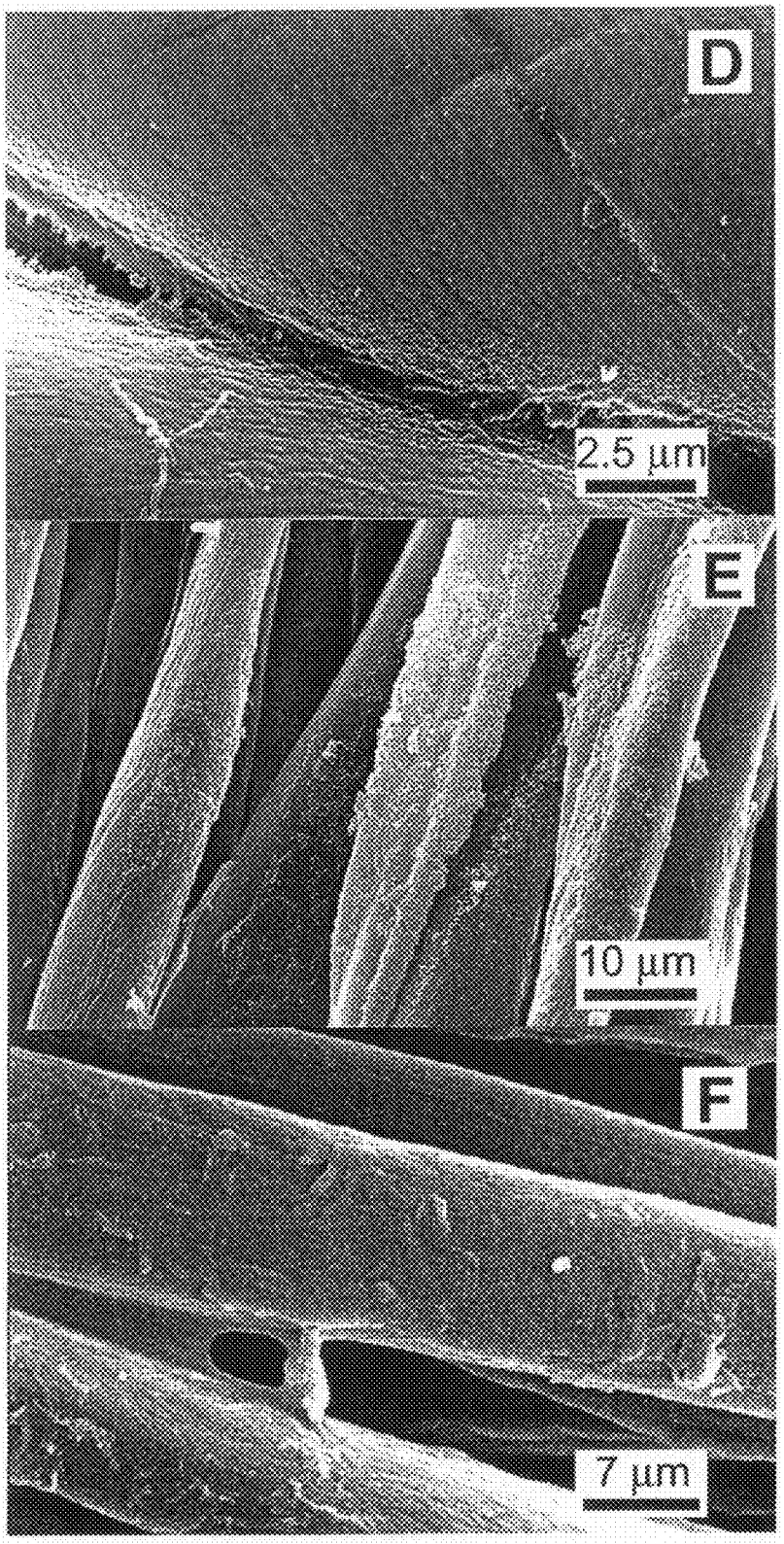

In order to analyze the dispersibility of NP on cotton fiber surface, SEM analysis is carried out using three other nanoparticles as controls, including: sodium styrenesulfate emulsified nanoparticles (NN), sodium dodecylsulfate emulsified nanoparticles (SN), and cetyltrimethylammonium bromide emulsified nanoparticles (SP). Compared with NP, these control samples all have similar particle size and functionality, but the only difference is the surfactant molecules in use. FIG. 13 displays the SEM images showing NP and NN nanoparticles treated fabric samples. The NP nanoparticles were able to form a uniform nanofilm on cotton surface (FIGS. 13-A, C); after heat treatment, the fiber surface was evenly covered with the nanoparticles (FIG. 13-E). However, the NN nanoparticles showed inferior coverage on cotton fiber surface because of agglomerations (FIGS. 13-B, D). They covered limited regions of the fiber surface, and formed lumps and stuck the adjacent fibers (FIG. 13-F), which resulted from both the mutual charge with fiber and the weak stability in $MgCl_2$ solution. All these three types of control nanoparticles showed inferior coverage to compare with the NP nanoparticles. The mechanical testing experiments of the cotton fabric samples using these three control nanoparticles all showed worse results compared with the NP nanoparticles. The concentration of each nanoparticle emulsion is 0.15 v/v %, DMDHEU is 15 wt %, and $MgCl_2$ is 12 g/L. Curing condition: 145° C. for 6.5 minutes.

Investigations on the Mechanism of the Nanoparticle Treatment for Fabrics.

As for a piece of cotton fiber, the secondary wall regions have a highly oriented, spiral microfibril infrastructure, which shows much higher crystallinity than the primary wall, therefore the axial stress between the adjacent microfibrils can be easily transferred from one to another. As for the primary wall, the cellulose content is in amorphous phase, after DP treatment, it turns from a soft, flexible form into a rigid and brittle one. Therefore, during the surface abrasion or fabric shearing, the crosslinked fiber surface ruptures easily and this results in peeling damage. The positively charged, reactive NP nanoparticles can absorb evenly onto the cotton fiber surface through a dipping process, and they formed a single layer at the fiber surface. After cure process, this thin layer gets into a uniform nanofilm which covalently bonds to the cotton fiber surface. The coating of NP nanoparticles can help to release the stress at the fiber surface. This thin film functions as a protecting jacket to remedy for the surface fatigue and resist the crack propagation at the fiber surface, so as to enhance the shear resistance of the DP cotton fiber (scheme 1). Moreover, because the NP nanoparticles' dry pick-up is at very low percentage (~0.01 wt %), and the nanofilm is evenly coated to the fiber surface, the affect to hand feel and water-absorbance of the fabric can be negligible.

Mechanical Properties Enhancement of the Textiles After Nanoparticle Treatments

The major mechanical testing results are listed below in Table 2. Table 2 shows that adding different concentrations (0.15 wt %, 0.30 wt %, 0.60 wt %) of NP to exemplary fabric samples results in improvement in tear resistance and abrasion resistance of approximately by 56% and 100%, respectively. The mechanical testing results show that the increment of NP content does not significantly affect the mechanical properties. Higher curing temperature (145° C. compared with 140° C.) results in the deterioration of tear resistance of the control samples, but minor effect on the NP treated samples. However, the NP treatment slightly lowers down the dry recovery angle (for example, when curing at 140° C., 0.6 wt % NP treatment resulted in 4° dry recovery angle decrease). This decrease may be the result of the unwelcome inter-connection of the cotton fiber with the nanoparticle lumps. Further raising the NP amount decreases the hand feel and wrinkle resistant property because of the aggregations of the nanoparticles. Besides these three concentrations, we also tested NP content treatment below 0.15 wt %, but the results were not very consistent, due to of the low adsorption efficiency in the simulated practical dipping process condition. Therefore we draw the conclusion that the NP treatment around 0.15 wt % to 0.6 wt % is an optimum treatment condition for DP process.

TABLE 2

Mechanical performances of NP treated fabric samples

| | Tear (N) | Tensile strength (MPa) | Dry recovery angle (o) | Abrasion (×1000 revolutions) |
|---|---|---|---|---|
| Cured at 140° C. | | | | |
| 0.15% | 10.97 ± 1.87 | 34.09 ± 1.53 | 141.5 ± 3.1 | 38.5 ± 2.1 |
| 0.30% | 11.88 ± 0.25 | 35.19 ± 0.66 | 141.3 ± 2.9 | 27 ± 8.5 |
| 0.60% | 12.19 ± 0.26 | 34.85 ± 1.51 | 137.5 ± 1.3 | 38 ± 6.0 |
| Control | 8.45 ± 0.25 | 33.31 ± 1.01 | 141.8 ± 1.3 | 19 ± 1.5 |

TABLE 2-continued

Mechanical performances of NP treated fabric samples

| | Tear (N) | Tensile strength (MPa) | Dry recovery angle (o) | Abrasion (×1000 revolutions) |
|---|---|---|---|---|
| Cured at 145° C. | | | | |
| 0.15% | 11.09 ± 0.15 | 33.21 ± 0.45 | 143.0 ± 0.8 | 27.0 ± 12.5 |
| 0.30% | 10.38 ± 0.77 | 32.65 ± 0.35 | 143.8 ± 1.0 | 33.5 ± 2.0 |
| 0.60% | 11.01 ± 0.68 | 34.21 ± 1.73 | 144.8 ± 1.0 | 21.5 ± 2.0 |
| Control | 7.05 ± 0.31 | 30.67 ± 1.28 | 145.5 ± 1.3 | 15.5 ± 0.5 |

It will be understood that in the exemplary embodiments, after curing the nanoparticles, a thin uniform monolayer is formed on the surface of the cotton fiber. The thin layer may be one nanoparticle thick, or at most a few nanoparticles. After the heat treatment the thickness of the film may even be a little less than the diameter of a single nanoparticle. The film is uniform in that there are no (or little) aggregations or clusters of nanoparticles.

Additionally, in exemplary embodiments, the nanoparticles may be provided with an electrical charge by choice of the surface modification, and that by controlling this electrical charge the formation of the film on the fabric and the resulting physical properties of the treated fiber can be enhanced. In particular it is desirable to provide the nanoparticles with an electrical charge that is opposite to any charge on the fabric. For example, cotton is known to have a negative charge and there may therefore be advantages in providing the nanoparticles with a positive charge. Where a fabric or fiber may have a positive charge then the nanoparticles may be modified to be provided with a negative charge.

There are a number of methods available for controlling the charge on the nanoparticles. For example, a number of monomers can be used to control the positive or negative charge, e.g., vinylbenzyltrimethyl ammonium chloride (positive) and sodium 4-vinylbenzenesulfonate (negative) in aqueous solution. It is also possible to use cetyltrimethylammonium bromide (positive) or sodium dodecylsulfate (negative) as surfactants to control the nanoparticles.

Figure 14:
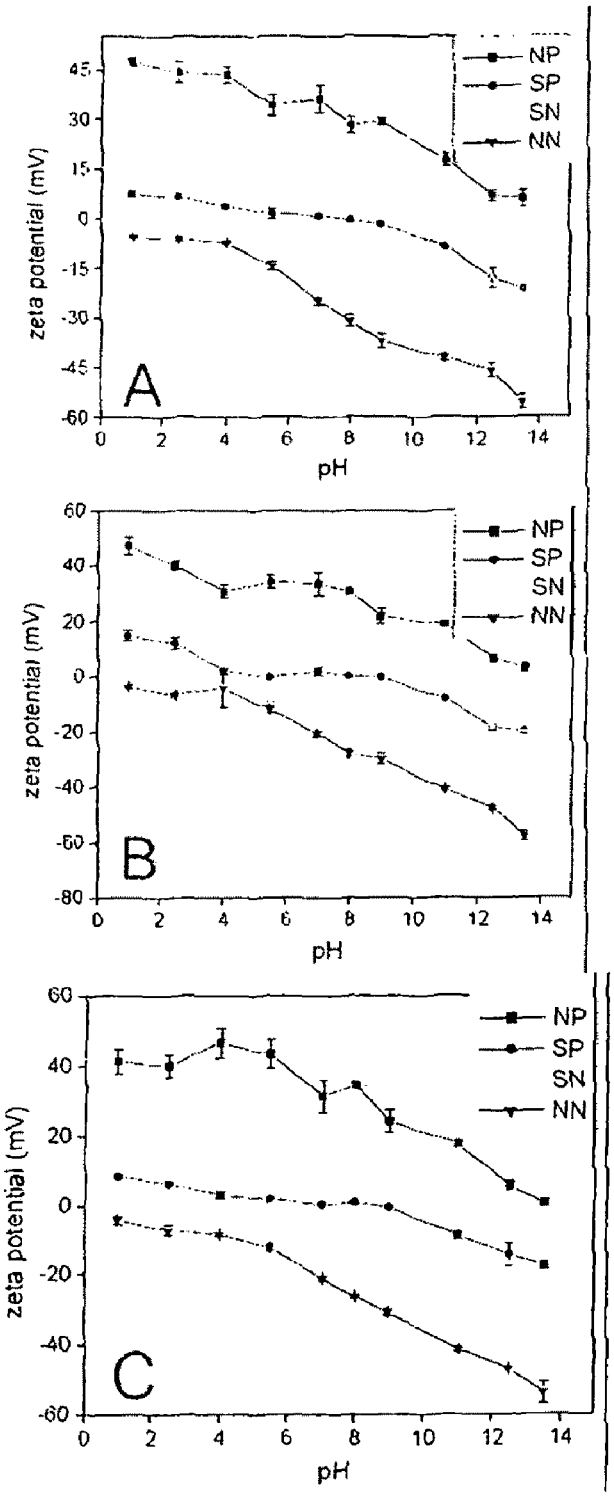
FIG. 14(*a*)-(*c*) shows the electrical charge applied to the nanoparticles in exemplary embodiments.

The charge on nanoparticles can be characterized by a zeta-potential method and FIGS. 14(*a*)-(*c*) show plots of zeta potential measured at different pH values at different nanoparticle concetrations: (a) 0.15%, (b) 0.3% and (c) 0.6%. In FIG. 14(*a*) "NP" represents the nanoaprticles NP referred to above and show a positive charge at a pH value of about 5 which is the pH of the batch solution used for fabric treatment. In FIGS. 14(*a*)-(*c*) SP means "surfactant-positive nanoparticle" which refers to the nanoparticles with positive surfactants; SN means "surfactant-negative nanoparticle" which refers to the nanoparticles with negative surfactants; NN means "non-surfactant-negative nanoparticle" which refers to the nanoparticles with negative charge but no surfactant used. Compared to NP nanoparticles, these different kinds of nanoparticles do not remain positively charged over the full pH range.

Referring to the example nanoparticles above, nanoparticles NP are known to have a positive charge while nanoparticles NN have a negative charge. Cotton normally has a negative charge (see, for example, Chattopadhyay, D. P., "Cationization of cotton for low-salt or salt-free dyeing," Indian Journal of Fibre & Textile Research (2001), 26(1 & 2), 108-115; and Chavan, R. B., Chattopadhyay, D. P., "Cationization of cotton for improved dyeability," Colourage Annual (1998), 127-133.

It will thus be seen that the described exemplary embodiments provide a method to control the physical and chemical properties of fibers or fabrics via hierarchical crosslinking architecture at nanometer or micrometer scale. The architecture, proved by scanning microscopy study, of the described exemplary embodiments can improve the mechanical properties of a fabric as evidenced by measurement of tensile strength, tear strength, and recovery angle of a cotton fabric. Exemplary architecture, which can consist of a thin film with nanometer or micrometer domains, is generated using nanoparticles and crosslinking reagents. The described exemplary embodiments provide methods that can be applied to various fibers, fabrics, or textiles for enhancing their properties. In comparison with conventional technology, these methods can give a well-defined structure, thus offering the potential for property design and control.

The invention claimed is:

1. A method of treating fibers, or yarns or fabrics or textiles comprising fibers, the method comprising:

(a) preparing polymer nanoparticles containing vinylbenzyltrimethylammonium chloride using an emulsion polymerization method;

(b) subjecting the fibers, or yarns or fabrics or textiles comprising fibers, to an aqueous solution comprising polymer nanoparticles, a catalyst and a cross-linking agent wherein the catalyst comprises magnesium chloride or zinc chloride;

(c) drying the fibers, or yarns or fabrics or textiles comprising fibers; and (d) curing the fibers, or yarns or fabrics or textiles comprising fibers to form a uniform thin polymer film on the surface of the fibers, or yarns or fabrics or textiles comprising fibers, wherein curing is performed as a single step at a temperature of between 110° C. to 180° C., for between 1 to 20 minutes.

2. The method as claimed in claim 1, wherein the polymer nanoparticles are formed of surface modified polystyrene.

3. The method as claimed in claim 1, wherein the polymer nanoparticles comprise polystyrene-co-polybutylacrylate nanoparticles.

4. The method as claimed in claim 1, wherein N-hydroxylmethyl acrylamide and hydroxylethyl methacrylate are used in said emulsion polymerization method so as to enhance the reactivity of the polymer nanoparticles towards said fibers.

5. The method as claimed in claim 1, wherein the crosslinking agent comprises dimethylol dihydroxyethyleneurea.

6. The method as claimed in claim 1, wherein the catalyst comprises magnesium chloride.

7. The method as claimed in claim 1, wherein the catalyst comprises zinc chloride.

8. The method as claimed in claim 1, wherein the concentration of the polymer nanoparticles and the cross-linking agent is selected to provide a wet pick-up of 60-70%.

* * * * *